US008388392B2

(12) United States Patent
Harada et al.

(10) Patent No.: US 8,388,392 B2
(45) Date of Patent: Mar. 5, 2013

(54) STEERING DEVICE FOR OUTBOARD ENGINE

(75) Inventors: Yoshihiro Harada, Wako (JP); Koichi Oka, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 204 days.

(21) Appl. No.: 12/947,273

(22) Filed: Nov. 16, 2010

(65) Prior Publication Data

US 2011/0117799 A1 May 19, 2011

(30) Foreign Application Priority Data

Nov. 19, 2009 (JP) ..... 2009-264041

(51) Int. Cl.
*B63H 20/08* (2006.01)
*B63H 25/10* (2006.01)

(52) U.S. Cl. ..... 440/58; 114/144 R

(58) Field of Classification Search ..... 440/53, 440/58, 61 R, 62, 63; 114/114 R, 144 RE
See application file for complete search history.

(56) References Cited

U.S. PATENT DOCUMENTS

| | | | | |
|---|---|---|---|---|
| 5,244,426 | A * | 9/1993 | Miyashita et al. | 440/60 |
| 5,427,555 | A * | 6/1995 | Merten | 440/61 B |
| 6,332,371 | B1 * | 12/2001 | Ohashi et al. | 74/331 |
| 7,097,520 | B2 * | 8/2006 | Okumura et al. | 440/1 |
| 2005/0181687 | A1 | 8/2005 | Okumura et al. | |
| 2007/0197110 | A1 | 8/2007 | Takada et al. | |

FOREIGN PATENT DOCUMENTS

| | | |
|---|---|---|
| EP | 0754619 A1 | 1/1997 |
| JP | 2005-231383 | 9/2005 |

* cited by examiner

*Primary Examiner* — Daniel Venne
*Assistant Examiner* — Anthony Wiest
(74) *Attorney, Agent, or Firm* — Rankin, Hill & Clark LLP

(57) ABSTRACT

A steering device for an outboard engine includes: a helm mechanism operable, in response to operation of a steering wheel, to steer the outboard engine and including a drive shaft parallel to an output shaft of the operation member; an electric assist mechanism for detecting steering torque, applied to the steering wheel, to assist operation of the helm mechanism on the basis of the detected steering torque; and a power transmission section for connecting the output shaft of the steering wheel and the helm mechanism to transmit rotation of the output shaft to the helm mechanism.

7 Claims, 8 Drawing Sheets

STEERING DEVICE FOR OUTBOARD ENGINE

FIELD OF THE INVENTION

The present invention relates to a steering device for an outboard engine which operates a helm mechanism (steering mechanism) in response to operation of a steering operation member, provided on the body of a boat, so as to steer the outboard engine via the helm mechanism.

BACKGROUND OF THE INVENTION

Generally, in boats provided with an outboard engine, a steering wheel or tiller handle is used as s steering operation member of a steering device for steering the outboard engine mounted on a rear end portion of the body of the boat. Among the conventionally-known outboard engine steering devices is one which includes an assist mechanism provided between a steering wheel and a hydraulic helm pump (i.e., helm mechanism), and in which steering force (operating force) of the steering wheel is assisted by the assist mechanism. One example of such a steering device is disclosed in Japanese Patent Application Laid-Open Publication No. 2005-231383 (JP 2005-231383 A).

With the prior art steering device disclosed in JP 2005-231383 A, as the steering wheel is operated, the steering force of the steering wheel is assisted by the assist mechanism, so that a drive shaft of the helm mechanism can be actuated with a relatively small steering force; namely, the necessary steering force of the steering wheel can be reduced by the provision of the assist mechanism. By the drive shaft of the helm mechanism being operated as above, oil is ejected from the helm mechanism and directed to a steering means, so that the steering means is actuated by the oil to steer the outboard engine.

However, the prior art steering device disclosed in JP 2005-231383 A, where the helm mechanism is provided in axial alignment with the steering wheel and assist mechanism, would undesirably have a great total length from the steering wheel to the helm mechanism. Thus, a relatively great installation space would be required in the body of the boat for installing the prior art steering device. Therefore, the application of the prior art steering device disclosed in JP 2005-231383 A is limited only to boats where a relatively great installation space can be secured in the body of the boat.

SUMMARY OF THE INVENTION

In view of the foregoing prior art problems, it is an object of the present invention to provide an improved steering device for an outboard engine which has a reduced total length from the steering operation member to the helm mechanism and thus can be installed, or applied to, in many different types of bodies of boats.

In order to accomplish the above-mentioned object, the present invention provides an improved steering device for an outboard engine, which comprises: a helm mechanism operable in response to operation of a steering operation member, provided on a body of a boat, to steer the outboard engine, the helm mechanism including a drive shaft disposed in generally parallel relation to an output shaft of the steering operation member: an electric assist mechanism for detecting steering torque, applied to the steering operation member, to assist operation of the helm mechanism on the basis of the detected steering torque; and a power transmission means for connecting the output shaft of the steering operation member and the helm mechanism to transmit rotation of the output shaft of the steering operation member to the helm mechanism.

In the present invention, the drive shaft of the helm mechanism (steering mechanism) is disposed in generally parallel (side-by-side) relation to, rather than in axial alignment with, the output shaft of the steering operation member (hereinafter referred to as "steering output shaft"), and the steering output shaft and the helm mechanism are interconnected via the power transmission section capable of transmitting the rotation of the steering output shaft to the helm mechanism. Because the drive shaft of the helm mechanism is disposed in generally parallel relation to the steering output shaft, the helm mechanism can be provided sideways of an end portion of the steering output shaft. Thus, the helm mechanism can be disposed so as not to project from the end portion of the steering output shaft in an axial direction of the steering output shaft. In this way, the present invention can reduce the total length of the steering device from the steering operation member to the helm mechanism. As a result, the steering device of the present invention can be constructed in a compact size and thus can be installed in, or applied to, many different types of bodies of boats.

Preferably, the power transmission section comprises any one of a pair of driving and driven gears, a chain and a belt. Thus, the rotation of the steering output shaft can be transmitted to the helm mechanism with a simplified construction. In this way, the present invention can not only reduce the total length of the steering device from the steering operation member to the helm mechanism, but also simplify the construction of the power transmission section and reduce the necessary manufacturing cost of the power transmission section.

Further, by changing a gear ratio in the case where the driving and driven gears are used as the power transmission section, a sprocket ratio in the case where the chain wound on driving and driven sprockets is used as the power transmission section or a pulley ratio in the case where the belt wound on driving and driven pulleys is used as the power transmission section, the present invention can adjust a steering angle of the steering operation member appropriately. Thus, the steering angle of the steering operation member can be adjusted optimally in accordance with operability required, for example, when the boat equipped with the steering device of the invention should leave a shore or should reach a shore.

Preferably, the helm mechanism comprises any one of a hydraulic helm pump for steering the outboard engine by hydraulic pressure and a mechanical helm mechanism for mechanically steering the outboard engine. In this case, the present invention permits selective use or provision of any suitable one of the hydraulic helm pump (i.e., hydraulic steering pump) and mechanical helm mechanism (i.e., mechanical steering mechanism) as the helm mechanism, depending on a type of the body of the boat. Namely, in assembling the steering device to the body of the boat, the present invention allows a suitable helm mechanism for the body of the boat to be selected from between the helm mechanism and the mechanical helm mechanism, and can thereby enhance a degree of design freedom of the steering device.

Preferably, the electric assist mechanism is controlled on the basis of the steering torque detected by the electric assist mechanism and the number of rotations of an engine for driving a propulsion propeller of the outboard engine. If the number of rotations of the engine increases to a considerable degree, the boat is brought into a high-speed state (region) so that reactive force against the propulsion propeller increases. Thus, in the high-speed region, the necessary steering force of the steering operation member increases. On the other hand, if the number of rotations of the engine decreases to a considerable degree, the boat is brought into a low-speed state (region) so that the reactive force against the propulsion propeller decreases. Thus, in the low-speed region, the necessary steering force of the steering operation member decreases. Therefore, in the present invention, the control section controls the electric assist mechanism on the basis of the number of rotations of the engine.

Thus, in high-speed gliding regions, the electric assist mechanism can be controlled to increase the steering force (assist force) of the steering operation member. In this way, the steering force to be applied to the steering operation member by a human operator can be reduced. In low-speed gliding regions, on the other hand, the electric assist mechanism can be controlled to decrease the steering force (assist force) of the steering operation member. In this way, the steering force to be applied to the steering operation member by the human operator can always be kept at suitable levels. Namely, stability of the steering, by the human operator, of the steering operation member can be enhanced by the steering force of the steering operation member being reduced in high-speed gliding regions and being kept at suitable levels in low-speed gliding regions.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

In the following description, the terms "front", "rear", "left" and "right" are used to refer to directions as viewed from a human operator aboard a boat.

Figure 1:
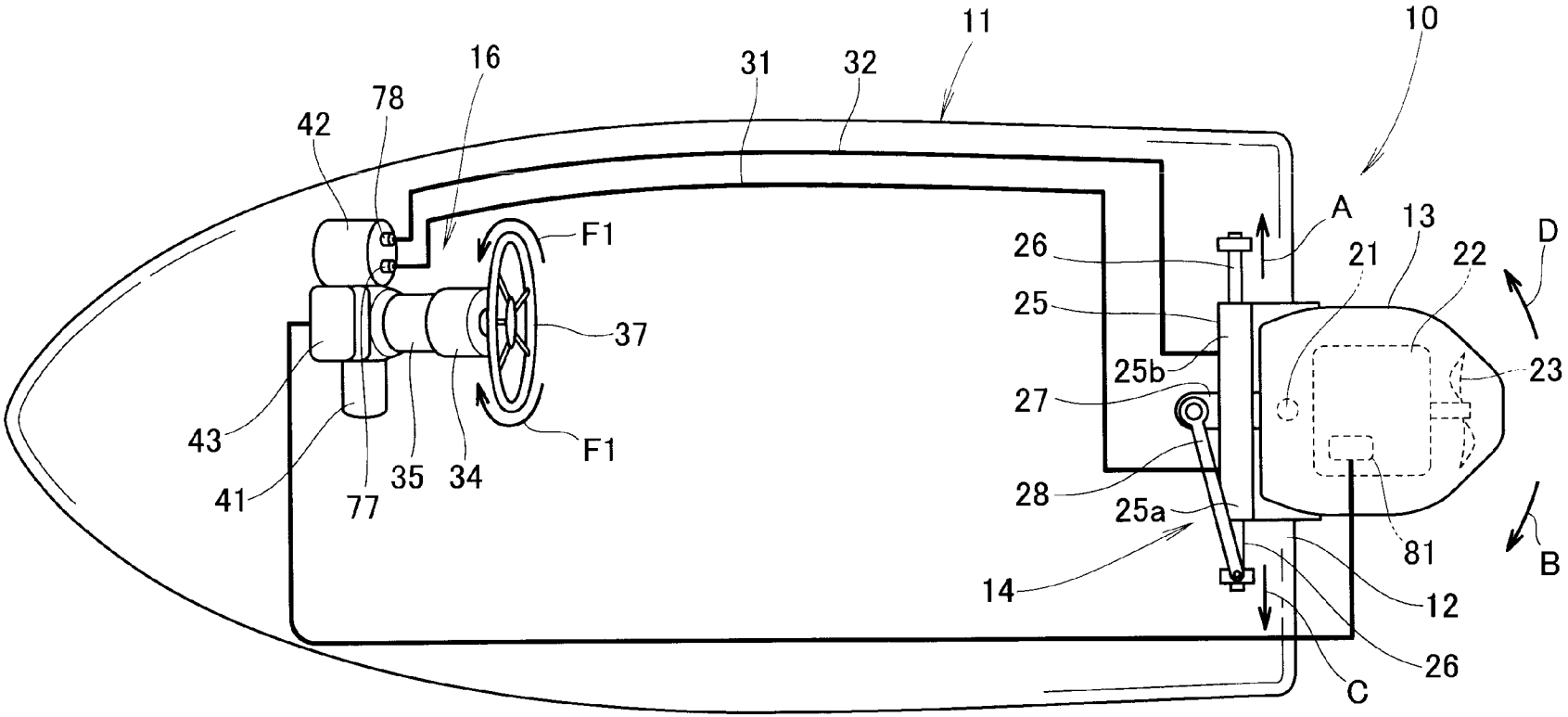
FIG. 1 is a plan view of the body of a boat provided with a first embodiment of a steering device for an outboard engine.

FIG. 1 is a plan view of the boat provided with a steering device for an outboard engine according to a first embodiment of the present invention. As shown, the outboard engine 10 includes: an outboard engine body 13 mounted to a stern 12 of the body 11 of the boat; a cylinder unit 14 for steering the outboard engine body 13; and the steering device 16 for operating the cylinder unit 14.

The outboard engine body 13 mounted to the stern 12 of the body 11 of the boat is pivotable in a horizontal left-right direction via a swivel shaft 21. The outboard engine body 13 has an engine 22 provided therein, and a propulsion propeller 23 is connected to the output shaft of the engine 22.

The cylinder unit 14 includes a steering cylinder 25 provided on stern 12 of the body 11 of the boat, and a rod 28 connecting an arm 27 to a steering piston 26 of the steering cylinder 25. The arm 27 is provided on the outboard engine body 13. The steering cylinder 25 has a left end portion 25*a* communicating with a left port portion 77 of a later-described helm mechanism 42 via a left steering pipe 31, and has a right end portion 25*b* communicating with a right port portion 78 of the helm mechanism 42 via a right steering pipe 32.

When hydraulic pressure acts on the left steering pipe 31 from the helm mechanism (steering mechanism) 42, the steering piston 26 moves rightward as indicated by arrow A and thus the outboard engine body 13 pivots leftward (clockwise in FIG. 1) about the swivel shaft 21 as indicated by arrow B. When hydraulic pressure acts on the right steering pipe 32 from the helm mechanism (steering mechanism) 42, on the other hand, the steering piston 26 moves leftward as indicated by arrow C and thus the outboard engine body 13 pivots rightward (counterclockwise in FIG. 1) about the swivel shaft 21 as indicated by arrow D.

Figure 2:
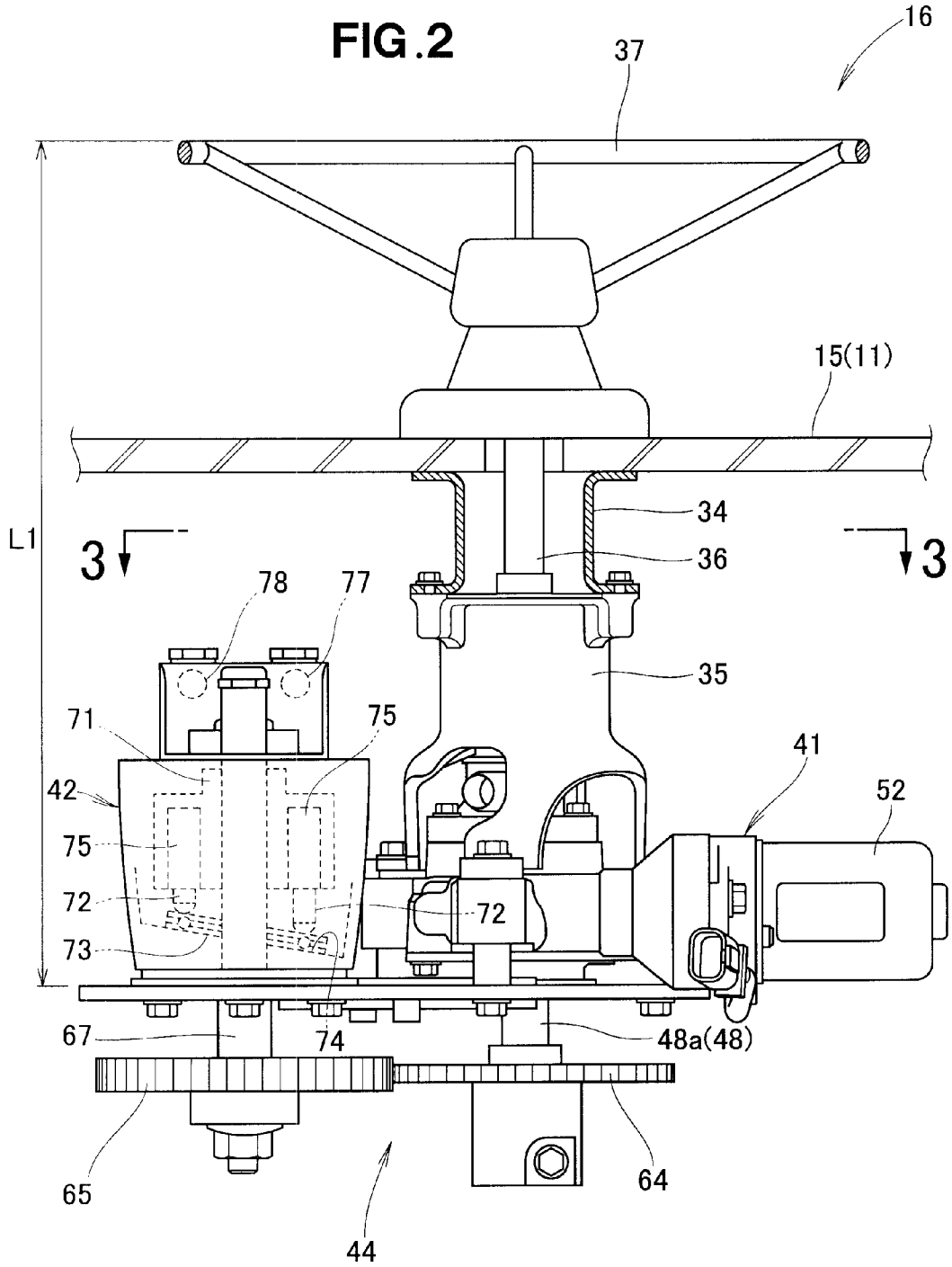
FIG. 2 is a side view of the steering device of FIG. 1.
Figure 3:
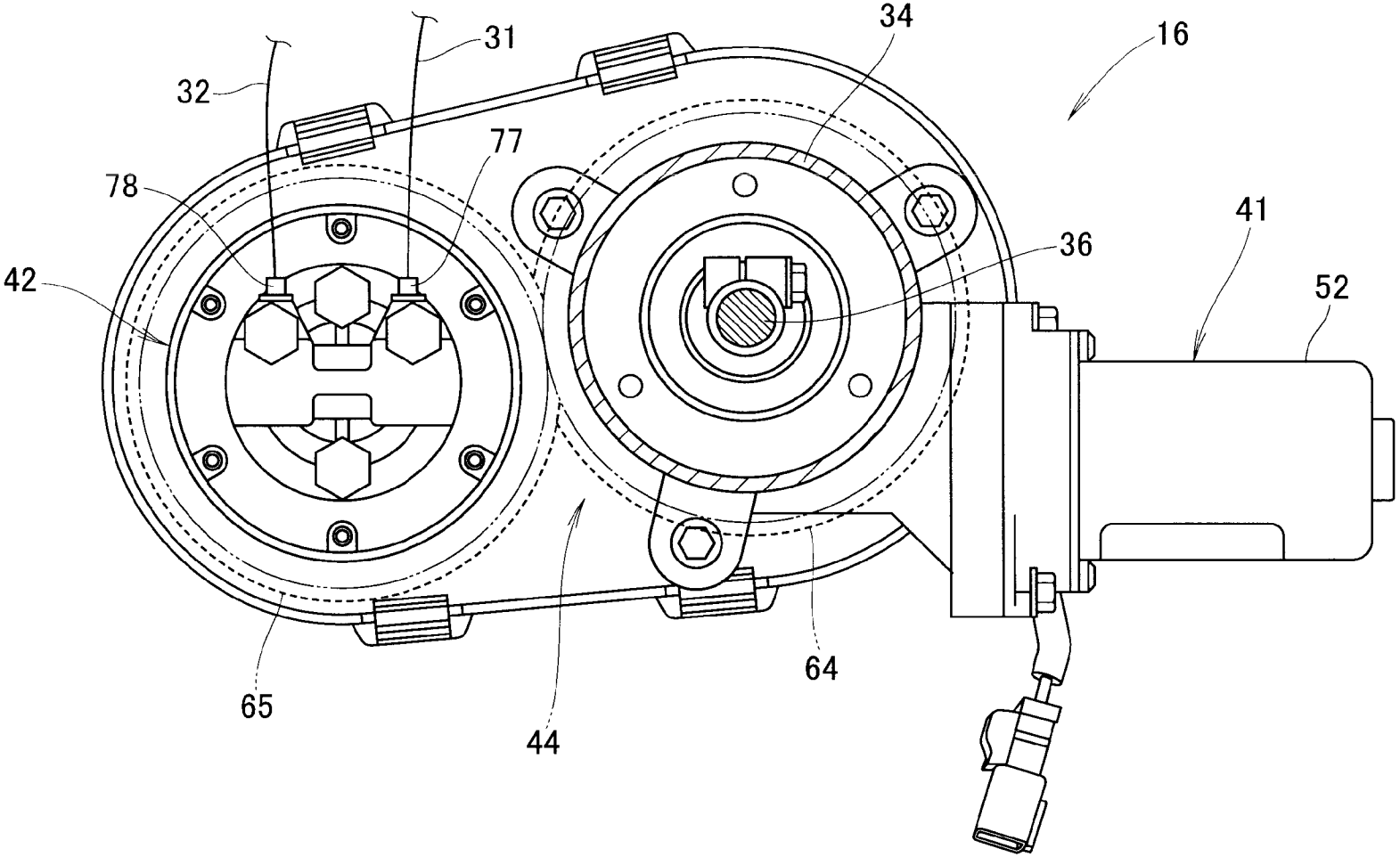
FIG. 3 is a sectional view taken along line 3-3 of FIG. 2.

As shown in FIGS. 2 and 3, the steering device 16 includes: an upper holder 34 fixedly mounted to an instrument panel 15 of the body 11 of the boat; a lower holder 35 connected to the upper holder 34; a steering wheel shaft unit 36 rotatably provided in the lower holder 35; and a steering wheel 37 provided as a steering operation member on an upper end portion of the steering wheel shaft unit 36.

The steering device 16 further includes: an electric assist mechanism 41 connected to a lower end portion of the steering wheel shaft unit 36; the helm mechanism 42 provided at a distance from the electric assist mechanism 41; a power transmission means or section 44 interconnecting the helm mechanism 42 and the electric assist mechanism 41; and a control section 43 (FIG. 1) that controls the electric assist mechanism 41.

The steering device 16 has a function of actuating the helm mechanism 42 in response to operation of the steering wheel 37 provided on the body 11 of the boat so as to steer the outboard engine body 13 via the helm mechanism 42. The steering device 16 further has a function of enhancing the operability of the steering wheel 37 via the electric assist mechanism 41 when the human operator operates the steering wheel 37.

Figure 4:
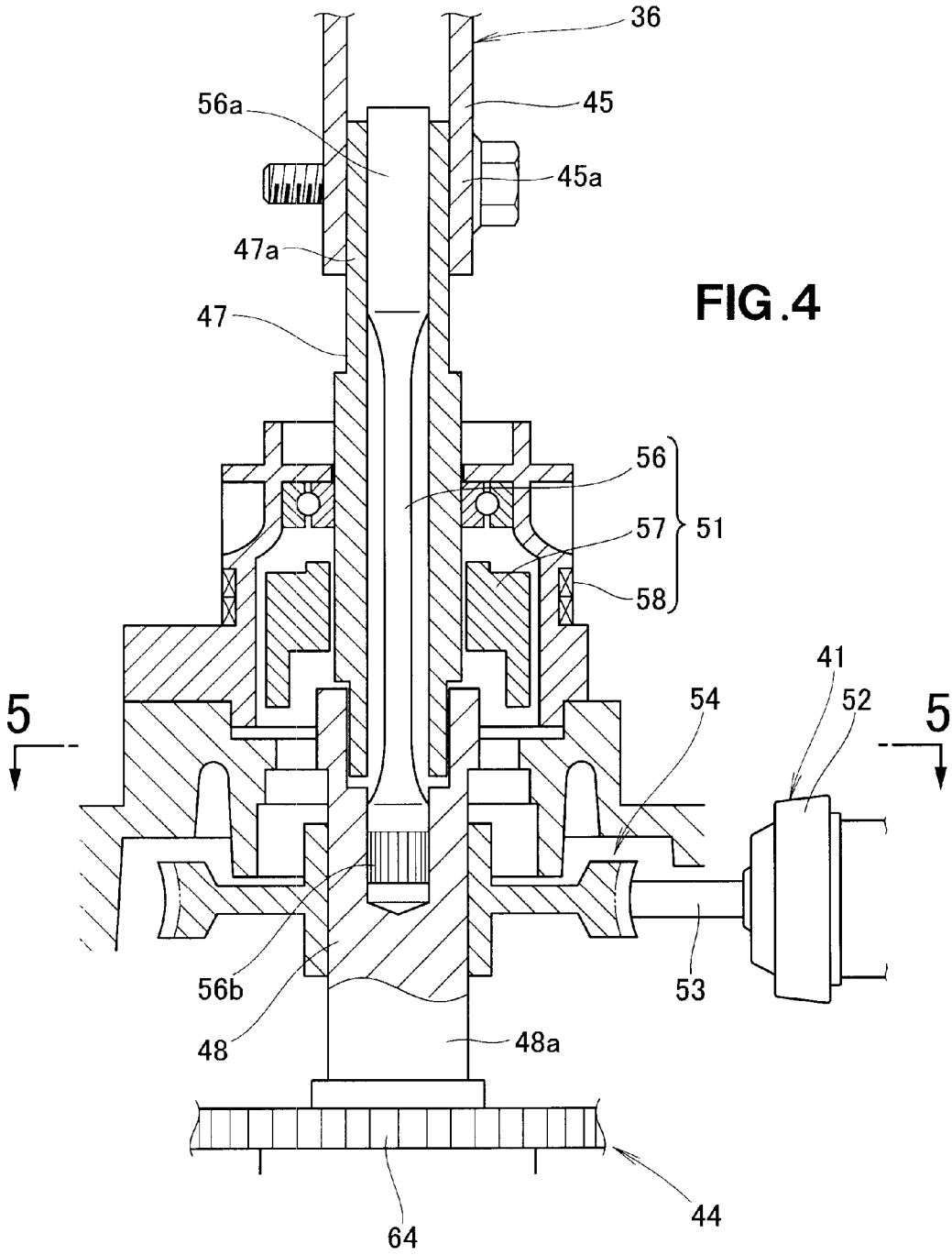
FIG. 4 is a sectional view of the steering device of FIG. 1, which particularly shows a torque sensor employed in the steering device of the present invention.
Figure 5:
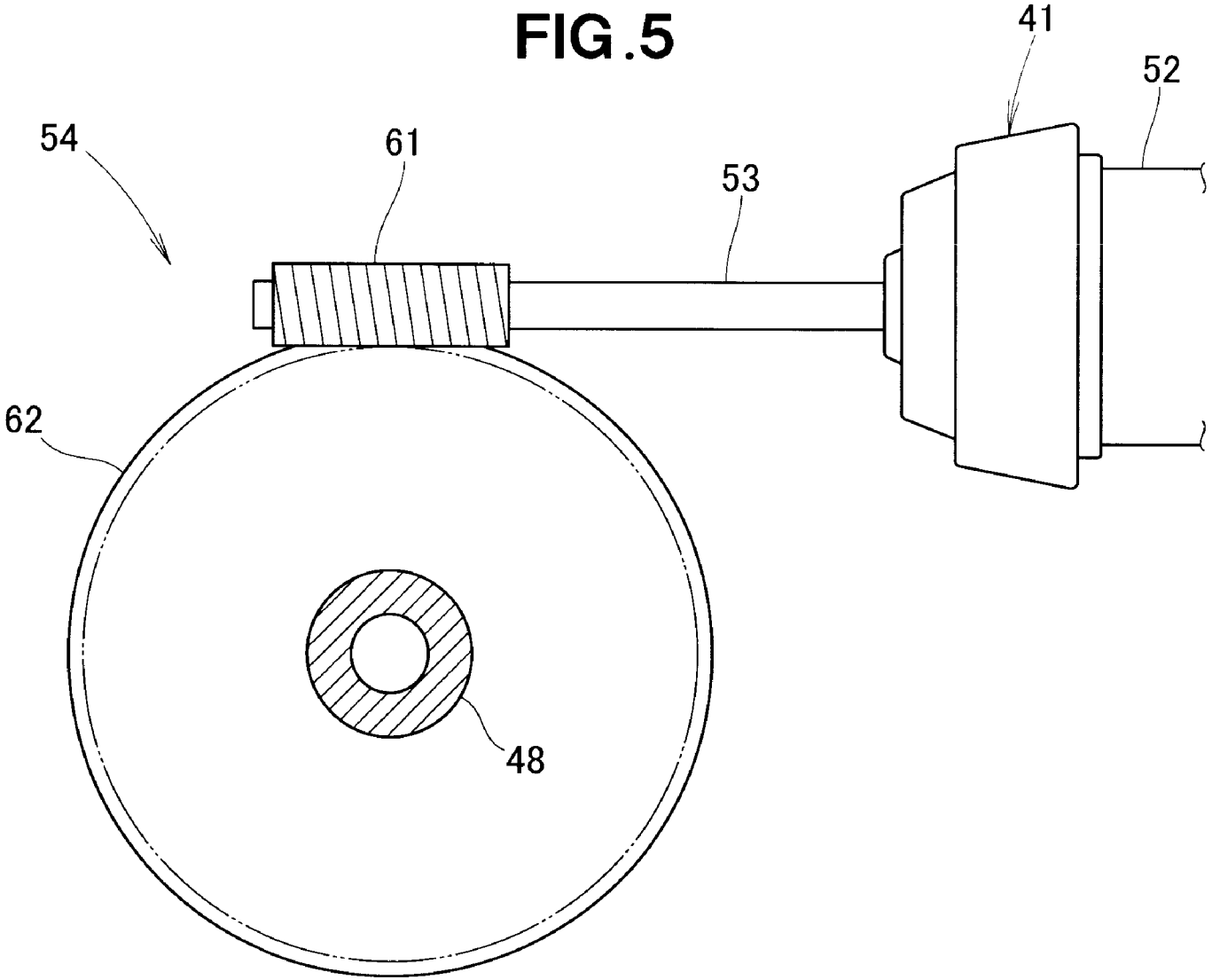
FIG. 5 is a sectional view taken along line 5-5 of FIG. 4.

As shown in FIGS. 4 and 5, the steering wheel shaft unit 36 includes: a steering wheel shaft 45 connected to the steering wheel 37; a hollow steering input shaft 47 having an upper end portion 47*a* communicating with a lower end portion 45*a* of the steering wheel shaft 45; and a steering output shaft 48 provided under and coaxially with the steering input shaft 47. The steering output shaft 48 is rotatably supported in coaxial relation to the steering input shaft 47.

The electric assist mechanism 41 includes: a torque sensor 51 for detecting steering torque transmitted to the steering input shaft 47; an electric actuator 52 actuatable or operable on the basis of the steering torque detected by the torque sensor 51; and an assist gear mechanism 54 that connects an output shaft 53 of the electric actuator 52 to the steering output shaft 48.

The torque sensor 51 is a conventional-type torque sensor which includes: a torsion bar 56 having an upper end portion 56*a* connected to the steering input shaft 47 and a lower end portion 56*b* connected to the steering output shaft 48; a torque ring 57 supported for movement in an axial direction of the torsion bar 56 (more specifically the steering input shaft 47); and a coil 58 provided around and radially outwardly of the torque ring 57.

The torque sensor 51 is constructed in such a manner that, when steering torque has been transmitted to the steering input shaft 47, torsion occurs in the torsion bar 56, the torque ring 57 movers in the axial direction of the steering input shaft 47 on the basis of the torsion of the torsion bar 56, an amount of the axial movement of the torque ring 57 is detected via the coil 58, and then the steering torque is detected on the basis of the detected amount of the axial movement.

The steering torque detected in the aforementioned manner is supplied to the control section 43 (FIG. 1). On the basis of the supplied detected steering torque, the control section 43 outputs a drive signal to the electric actuator 52. The electric actuator 52 is a conventional-type electric motor driven on the basis of the drive signal from the control section 43; more specifically, the output shaft 53 is rotated by the electric actuator 52 on the basis of the drive signal. A pinion 61 (FIG. 5) of the assist gear mechanism 54 is provided on the output shaft 53.

The assist gear mechanism 54 includes the pinion 61 provided on the output shaft 53 of the electric actuator 52, and a helical gear 62 mounted on the steering output shaft 48 and meshing with the pinion 61.

The output shaft 53 of the electric actuator 52 is disposed orthogonally to the steering wheel shaft unit 36 (more specifically, steering output shaft 48) connected to the steering wheel 37. With the pinion 61 meshing with the helical gear 62, the rotation of the pinion 61 can be transmitted to the steering output shaft 48 via the helical gear 62.

The pinion 61 rotates together with the output shaft 53 as the electric actuator 52 operates on the basis of the detected steering torque. Thus, the rotation of the steering output shaft 48 can be assisted by the electric actuator 52 (electric assist mechanism 41). In this way, the steering force (steering torque) of the steering wheel 37 can be assisted by the electric assist mechanism 41. Thus, the human operator can operate the steering wheel 37 with a relatively small steering force, which achieves an enhanced operability of the steering device.

In addition, the electric assist mechanism 41 has a function for assisting the steering force of the steering wheel 37 on the basis of the number of rotations of the engine 22 (hereinafter referred to as "number of engine rotations"). Namely, the electric assist mechanism 41 is constructed to be capable of appropriately controlling the operation of the steering wheel 37 on the basis of the detected steering torque and number of engine rotations.

The steering output shaft 48 projects downward below the helical gear 62 of the electric assist mechanism 41 (more specifically the assist gear mechanism 54). The steering output shaft 48 has a lower end portion 48*a* connected to the helm mechanism 42 (FIG. 2) via the power transmission means or section 44.

As shown in FIGS. 2 and 3, the power transmission section 44 includes a driving gear 64 mounted on the lower end portion 48*a* of the steering output shaft 48 in coaxial relation thereto, and a driven gear 65 mounted on a drive shaft 67 of the helm mechanism 42 in coaxial relation thereto and meshing with the driving gear 64.

Thus, the rotation of the steering output shaft 48 can be transmitted to the drive shaft 67 of the helm mechanism 42 via the driving gear 64 and driven gear 65. The power transmission section 44, comprising the driving gear 64 and driven gear 65, allows the rotation of the steering output shaft 48 to be transmitted to the helm mechanism 42 with a simplified construction.

Further, changing a gear ratio between the driving gear 64 and the driven gear 65 of the power transmission section 44 allows the steering angle of the steering wheel 37 to be adjusted appropriately. In this way, the steering angle of the steering wheel 37 can be adjusted optimally in accordance with operability required, for example, when the boat should leave a shore or should reach a shore.

Furthermore, because the steering output shaft 48 and the drive shaft 67 of the helm mechanism 42 are interconnected via the power transmission section 44, the drive shaft 67 can be provided in generally parallel side-by-side relation to the steering output shaft 48, and thus, the helm mechanism 42 can be disposed between the steering wheel 37 and the lower end portion 48*a* of the steering output shaft 48 above the lower end portion 48*a*.

Thus, the helm mechanism 42 can be disposed so as not to project from the lower end portion 48*a* of the steering output shaft 48 downward in the axial direction of the steering output shaft 48. In this manner, it is possible to reduce a total length L1 of the steering device 16 from the steering wheel 37 to the helm mechanism 42. As a result, the steering device 16 can be constructed in a compact size and thus can be installed in, or applied to, many different types of bodies of boats.

Further, with the power transmission section 44 comprising the driving gear 64 and driven gear 65, the rotation of the steering output shaft 48 can be transmitted to the helm mechanism 42 with a simplified construction, as noted above. As a result, not only the total length L1 of the steering device 16 from the steering wheel 37 to the helm mechanism 42 can be reduced, but also the power transmission section 44 can be simplified in construction and can be manufactured at reduced cost.

The helm mechanism 42 is a hydraulic helm pump (hydraulic steering pump) that steers the outboard engine body 13 by hydraulic pressure. The helm mechanism 42 includes a rotary member 71 that rotates together with the drive shaft 67 as the drive shaft 67 rotates, and a piston 72 rotates together with the rotary member 71 as the rotary member 71 rotates.

The piston 72 moves in its axial direction by rotating while sliding in contact with a slanting plate 74 via a bearing 73, to thereby eject oil out of a cylinder 75. Namely, the helm mechanism 42 is a conventional-type piston pump (plunger pump).

Further, in the instant embodiment, the left steering pipe 31 is disposed in communication with the left port portion 77 of the helm mechanism 42, while the right steering pipe 32 is disposed in communication with the right port portion 78 of the helm mechanism 42.

With the oil ejected from the helm mechanism 42, hydraulic pressure acts on any one of the left steering pipe 31 and right steering pipe 32 of the steering cylinder 25 shown in FIG. 1, so that the steering piston 26 of the steering cylinder 25 moves leftward or rightward. Thus, the outboard engine body 13 pivots leftward or rightward about the swivel shaft 21, so that the body 11 of the boat can be steered leftward or rightward. In the aforementioned manner, the outboard engine body 13 can be steered by hydraulic pressure, using the helm mechanism 42.

Further, as shown in FIGS. 1 and 4, the control section 43 has a function of supplying a drive signal to the electric assist mechanism 41 (electric actuator 52) on the basis of steering torque detected by the torque sensor 51. Thus, as the human operator operates the steering wheel 37, the steering force (steering torque) F1 of the steering wheel 37 can be assisted by the electric assist mechanism 41, as set forth above. As a result, the human operator can operate the steering wheel 37 with a relatively small steering force F1; namely, the steering device can be operated with an enhanced operability.

If the number of rotations of the engine 22 increases to a considerable degree, the boat is brought into a high-speed gliding state (region) so that reactive force against the propulsion propeller 23 increases. Thus, in the high-speed gliding region, the necessary steering force F1 of the steering wheel 37 increases. On the other hand, if the number of rotations of the engine 22 decreases to a considerable degree, the boat is brought into a low-speed gliding state (region) so that the reactive force against the propulsion propeller 23 decreases. Thus, in the low-speed gliding region, the necessary steering force F1 of the steering wheel 37 decreases.

Therefore, the control section 43 is equipped with the function of supplying a drive signal to the electric assist mechanism 41 (electric actuator 52) on the basis of the number of engine rotations. More specifically, the number of engine rotations is detected by a number of rotation detection section 81 (FIG. 1) and supplied to the control section 43.

If the detected number of engine rotations is relatively great, the control section 43 supplies the electric actuator 52 with a signal such that the steering assistance by the electric assist mechanism 41 can be promoted. Thus, in high-speed gliding regions, the electric assist mechanism 41 can be controlled by the control section 43 to increase the steering force (assist force) of the steering wheel 37. In this way, the steering force F1 to be applied to the steering wheel 37 by the human operator can be reduced.

On the other hand, if the detected number of engine rotations is relatively small, the control section 43 supplies the electric actuator 52 with a signal such that the steering assistance by the electric assist mechanism 41 can be suppressed. Thus, in low-speed gliding regions, the electric assist mechanism 41 can be controlled to decrease the steering force (assist force) of the steering wheel 37. In this way, the steering force F1 to be applied to the steering wheel 37 by the human operator can always be kept at suitable levels.

Namely, stability of the steering, by the human operator, of the steering wheel 37 can be enhanced by the steering force F1 to be applied to the steering wheel 37 being reduced in high-speed gliding regions and being kept at suitable levels in low-speed gliding regions.

Next, a description will be given about second to fourth embodiments of the present invention with reference to FIGS. 6 to 9, where similar elements to those in the first embodiment of the steering device 16 are indicated by the same reference numerals and characters as used for the first embodiment and will not be described here to avoid unnecessary duplication.

The following describe a second embodiment of the steering device 90. As seen from FIGS. 3 and 7, the second embodiment of the steering device 90 is different from the first embodiment of the steering device 16 in that it includes a mechanical helm mechanism (mechanical steering mechanism) 92 in place of the helm mechanism 42 employed in the first embodiment, but similar to the first embodiment in other respects.

Figure 7:
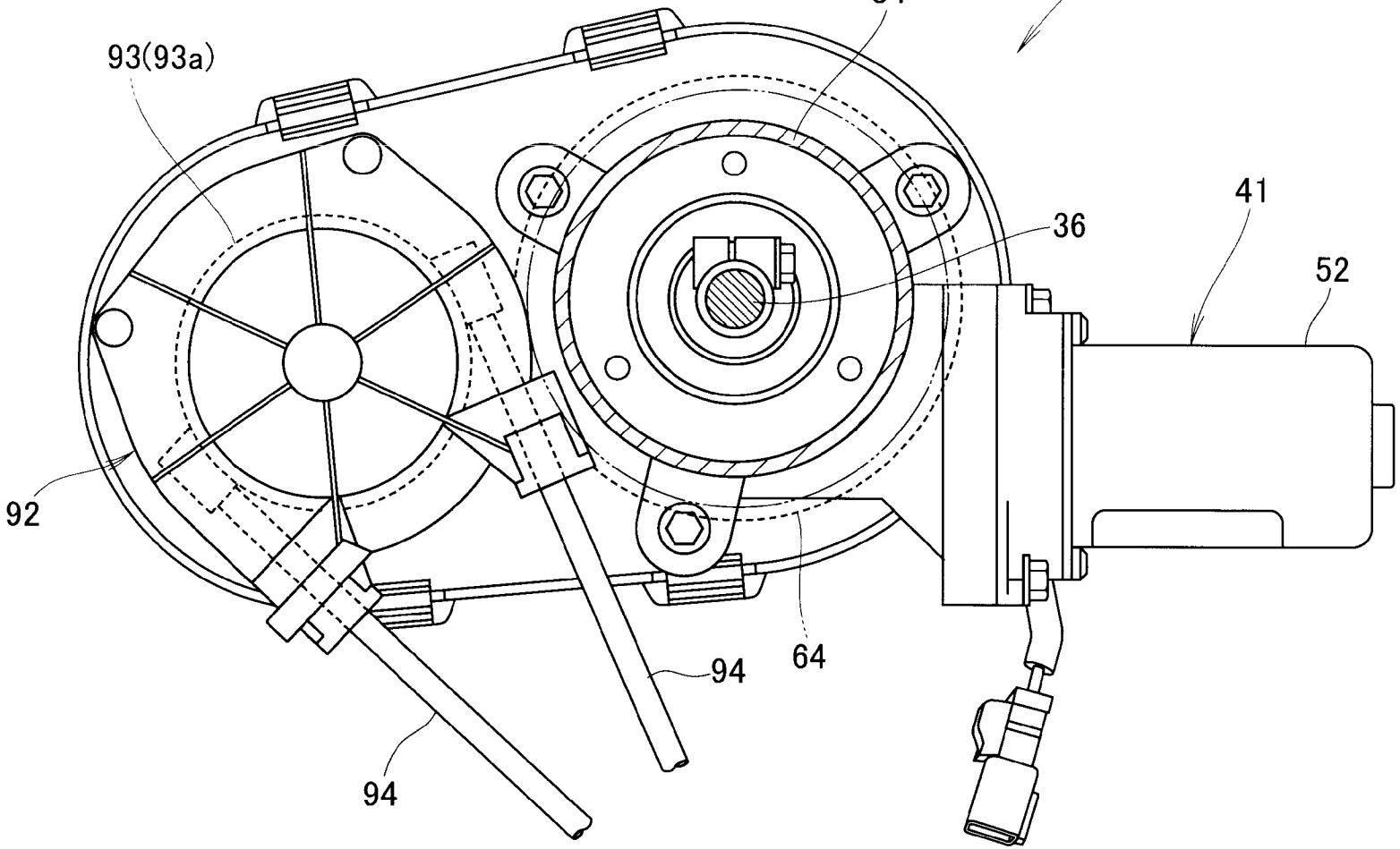
FIG. 7 is a sectional view taken along line 7-7 of FIG. 6.

In the mechanical helm mechanism 92, a pulley 93 of FIG. 7 is mounted on the drive shaft 67 in coaxial relation thereto, and an operating cable 94 is wound on the outer periphery 93*a* of the pulley 93. More specifically, part of the operating cable 94 is taken out from a case 95 so that a pair of end portions 94*a* and 94*b* of the operating cable 94 extend to the outboard engine 13 (see also FIG. 1). One of the end portions 94*a* is connected to a right end portion 97*a* of a steering rod 97, while the other end portion 94*b* is connected to a left end portion 97*b* of the steering rod 97.

Figure 6:
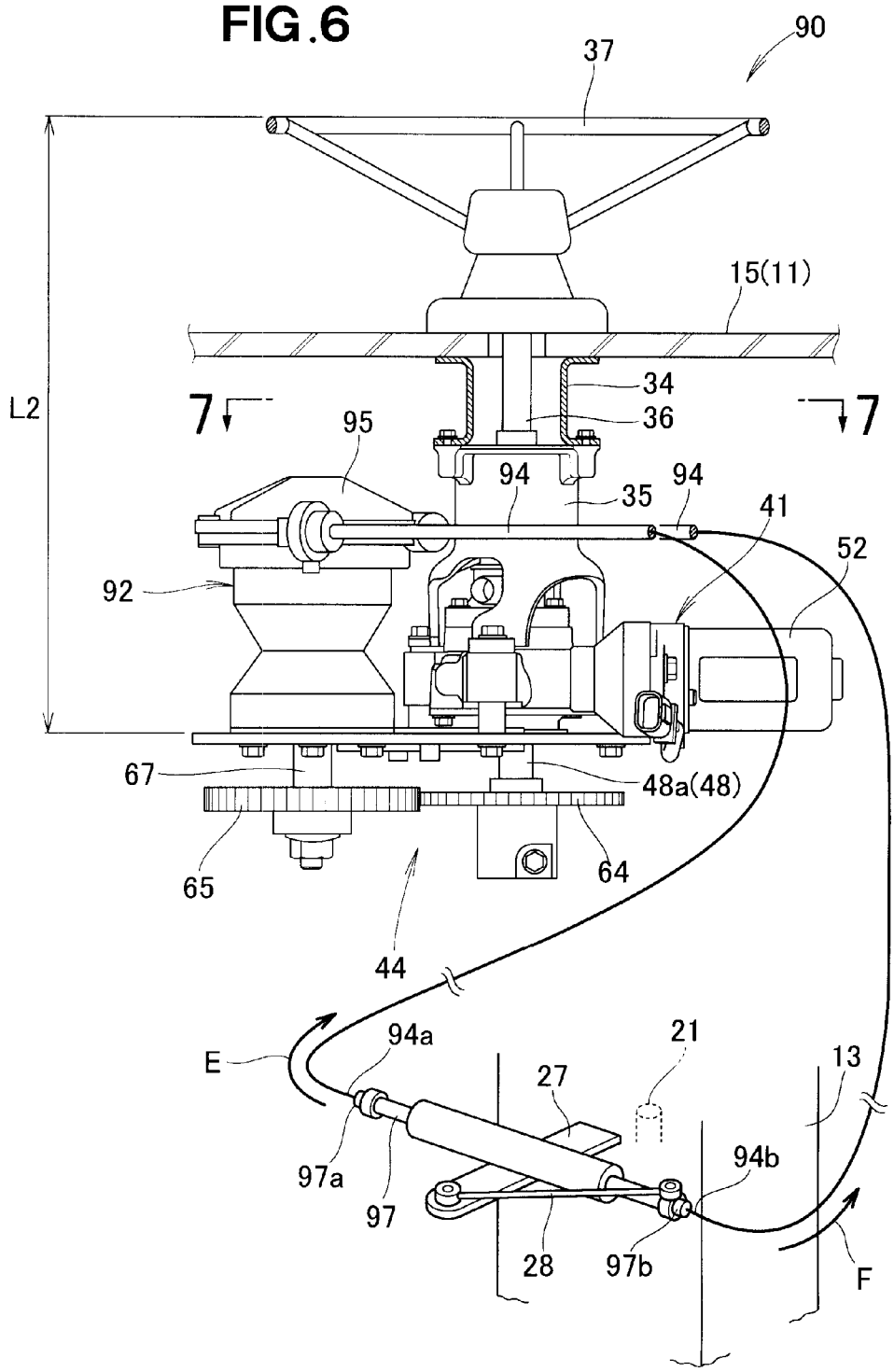
FIG. 6 is a side view of a second embodiment of the steering device of the present invention.

As the steering wheel 37 is steered leftward, the steering output shaft 48 rotates counterclockwise, so that the drive shaft 67 rotates clockwise in FIG. 6 via the power transmission section 44. Thus, the pulley 93 rotates clockwise in FIG. 6 together with the drive shaft 67, so that the end portion 94*a* is pulled back toward the case 95 as indicated by arrow E. As a consequence, the steering rod 97 moves rightward, so that the outboard engine body 13 pivots leftward about the swivel shaft 21.

On the other hand, as the steering wheel 37 is steered rightward, the steering output shaft 48 rotates clockwise, so that the drive shaft 67 rotates counterclockwise in FIG. 6 via the power transmission section 44. Thus, the pulley 93 rotates counterclockwise in FIG. 6 together with the drive shaft 67, so that the end portion 94*b* is pulled back toward the case 95 as indicated by arrow F. As a consequence, the steering rod 97 moves leftward, so that the outboard engine body 13 pivots rightward about the swivel shaft 21.

Namely, the mechanical helm mechanism 92 in the second embodiment is a mechanism for mechanically steering the outboard engine body 13. In one preferred implementation, the helm mechanism to be provided in the steering device may be selected from between the aforementioned helm mechanism 42 employed in the first embodiment and the aforementioned mechanical helm mechanism 92. Namely, when assembling the steering device to the body of the boat, a suitable helm mechanism for the body 11 of the boat can be selected from between the helm mechanism 42 and the mechanical helm mechanism 92. In this way, it is possible to enhance a degree of design freedom of the steering device.

Thus, similarly to the first embodiment of the steering device 16, the second embodiment of the steering device 90 allows the drive shaft 67 to be provided in generally parallel side-by-side relation to the steering output shaft 48 with the steering output shaft 48 and the drive shaft 67 of the mechanical helm mechanism 92 interconnected via the power transmission section 44. Thus, the mechanical helm mechanism 92 can be disposed between the steering wheel 37 and the lower end portion 48*a* of the steering output shaft 48 above the lower end portion 48*a*.

Thus, the mechanical helm mechanism 92 can be disposed so as not to project from the lower end portion 48*a* of the steering output shaft 48 downward in the axial direction of the steering output shaft 48. In this way, it is possible to reduce a total length L2 of the steering device 90 from the steering wheel 37 to the mechanical helm mechanism 92. As a result, the second embodiment of the steering device 90 can be constructed in a compact size and thus can be installed in, or applied to, many different types of bodies of boats.

Further, the second embodiment of the steering device 90 can achieve the same advantageous benefits as the first embodiment of the steering device 16.

The following describe a third embodiment of the present invention, which is characterized by provision of a power transmission section 100 in place of the power transmission section 44 provided in the first embodiment.

Figure 8:
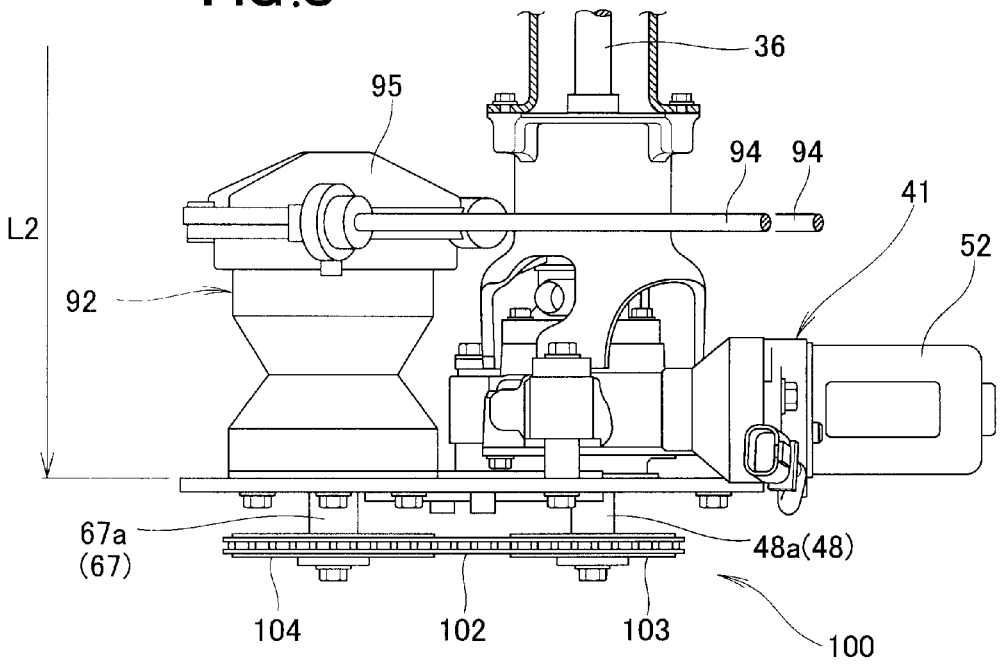
FIG. 8 is a side view of a power transmission section employed in a third embodiment of the present invention.

As shown in FIG. 8, the power transmission section 100 includes an endless chain 102 in place of the driving gear 64 and driven gear 65 of the power transmission section 44 provided in the first embodiment; the other components of the power transmission section 100 are similar to those of the power transmission section 44.

More specifically, a driving sprocket 103 is mounted on the lower end portion 48*a* of the steering output shaft 48 in coaxial relation thereto, and a driven sprocket 104 is mounted on a lower end portion 67*a* of the drive shaft 67 in coaxial relation thereto. The endless chain 102 is wound on the driving sprocket 103 and driven sprocket 104. A plurality of projections formed on and along the outer periphery of the driving sprocket 103 and a plurality of projections formed on and along the outer periphery of the driven sprocket 104 mesh with opposite portion of the chain 102.

Thus, similarly to the power transmission section 44 provided in the first and second embodiments, the power transmission section 100 in the third embodiment can transmit the rotation of the steering output shaft 48 to the drive shaft 67 of the mechanical helm mechanism 92 via the driving sprocket 103, chain 102 and driven sprocket 104.

The power transmission section 100, comprising the chain 102 as set forth above, can transmit the rotation of the steering output shaft 48 to the mechanical helm mechanism 92 with a simplified construction. Thus, the third embodiment can reduce the total length L2 of the steering device from the steering wheel 37 to the mechanical helm mechanism 92, simplify the construction of the power transmission section 100 and reduce the necessary manufacturing cost of the power transmission section 100.

Furthermore, changing a sprocket ratio (i.e., diameter ratio) between the driving sprocket 103 and the driven sprocket 104 allows the steering angle of the steering wheel 37 to be adjusted appropriately. In this way, the steering angle of the steering wheel 37 can be adjusted optimally in accordance with operability required, for example, when the boat should leave a shore or should reach a shore.

The following describe a fourth embodiment of the present invention, which is characterized by provision of a power transmission section 110 in place of the power transmission section 44 provided in the first embodiment.

Figure 9:
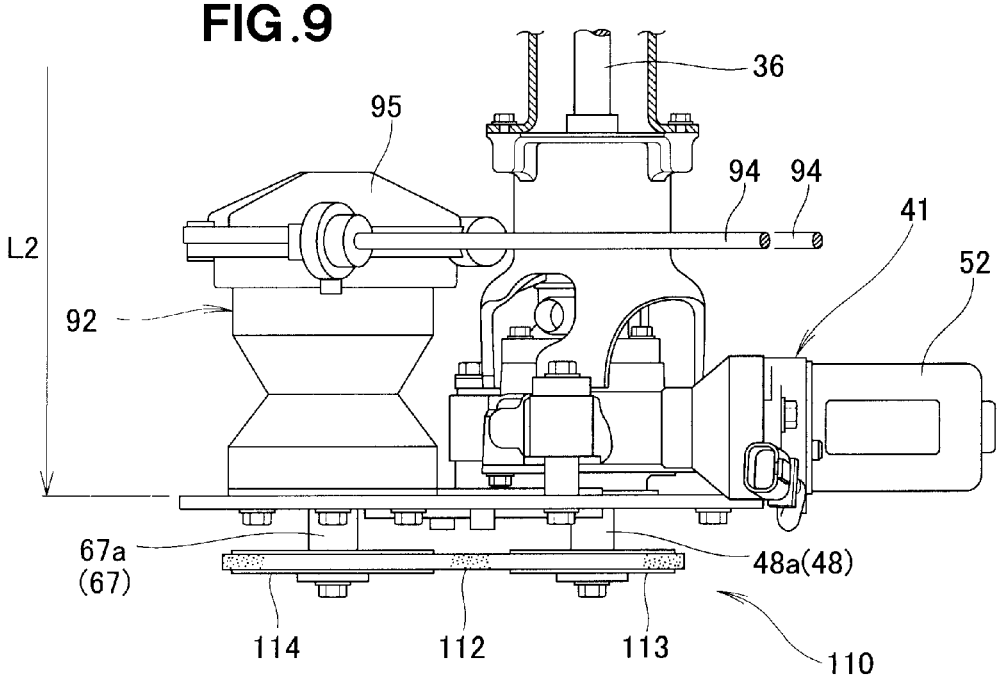
FIG. 9 is a side view of a power transmission section employed in a fourth embodiment of the present invention.

As shown in FIG. 9, the power transmission section 110 includes a belt 112 in place of the driving gear 64 and driven gear 65 of the power transmission section 44 provided in the first embodiment; the other components of the power transmission section 110 are similar to those of the power transmission section 44.

More specifically, a driving pulley 113 is mounted on the lower end portion 48*a* of the steering output shaft 48 in coaxial relation thereto, and a driven pulley 114 is mounted on a lower end portion 67*a* of the drive shaft 67 in coaxial relation thereto. An endless belt 112 is wound on the driving pulley 113 and driven pulley 114.

Thus, similarly to the power transmission section 44 provided in the first and second embodiments, the power transmission section 110 in the fourth embodiment can transmit the rotation of the steering output shaft 48 to the drive shaft 67 of the mechanical helm mechanism 92 via the belt 112.

The power transmission section 110, comprising the belt 112 as set forth above, can transmit the rotation of the steering output shaft 48 to the mechanical helm mechanism 92 with a simplified construction. Thus, the fourth embodiment can reduce the total length L2 of the steering device from the steering wheel 37 to the mechanical helm mechanism 92, simplify the construction of the power transmission section 110 and reduce the necessary manufacturing cost of the power transmission section 110.

Furthermore, changing a pulley ratio (i.e., diameter ratio) between the driving pulley 113 and the driven pulley 114 of the power transmission section 110 allows the steering angle of the steering wheel 37 to be adjusted appropriately. In this way, the steering angle of the steering wheel 37 can be adjusted optimally in accordance with operability required, for example, when the boat should leave a shore or should reach a shore.

It should be appreciated that the steering devices 16 and 90 of the present invention are not limited to the above-described embodiments and may be modified as necessary.

For example, whereas the first to fourth embodiments have been described above in relation to the case where the steering operation member is in the form of the steering wheel 37, the present invention is not so limited, and another suitable type of steering operation member, such as a tiller handle, may be used.

Further, whereas the first embodiment has been described above in relation to the case where the helm mechanism 42 employs a piston pump (plunger pump), it is not so limited, and the helm mechanism 42 may employ any other suitable type of pump, such as a cylinder-type hydraulic pressure generation device. The cylinder-type hydraulic pressure generation device may be constructed in such a manner that a pinion rotates together with the drive shaft 67 as the drive shaft 67 rotates, a rack moves in an axial direction of the cylinder in response to rotation of the pinion, a pair of pistons move in the axial direction of the cylinder in response to the movement of the rack, and oil is ejected from within the cylinder in response to the movement of the pair of pistons.

Furthermore, the shapes and constructions of the outboard engine 10, body 11 of the boat, engine 22, propulsion propeller 23, steering wheel 37, electric assist mechanism 41, helm mechanism 42, control section 43, power transmission sections 44, 100 and 110, steering output shaft 48, electric actuator 52, driving gear 64, driven gear 65, drive shaft 67 of the helm mechanism, mechanical helm mechanism 92, chain 102, belt 112, etc. are not limited to those described above and may be modified as necessary.

The basic principles of the present invention are well suited for application to outboard engines equipped with a steering device where a helm mechanism is actuated.

Obviously, various minor changes and modifications of the present invention are possible in light of the above teaching. It is therefore to be understood that within the scope of the appended claims the invention may be practiced otherwise than as specifically described.

What is claimed is:

1. A steering device for an outboard engine, comprising:

a steering operation member provided on a body of a boat, said steering operation member having a steering operation member shaft and a steering output shaft, said steering operation member shaft and said steering output shaft being rotatably supported in coaxial relation to one another;

a helm mechanism operable in response to operation of the steering operation member to steer the outboard engine, the helm mechanism including a drive shaft disposed in generally parallel relation to the steering output shaft and the steering operation member shaft:

an electric assist mechanism for detecting steering torque, applied to the steering operation member shaft via the steering operation member, said electric assist mechanism being operable to assist rotation of the steering output shaft based upon steering torque detected at said steering operation member shaft; and a power transmission section that directly mechanically connects the steering output shaft to the helm mechanism drive shaft so as to transmit rotation of the steering output shaft to the helm mechanism drive shaft.

2. The steering device of claim 1, wherein the power transmission section comprises a driving gear on the steering output shaft that drivingly meshes with a driven gear on the helm mechanism drive shaft.

3. The steering device of claim 1, wherein the helm mechanism comprises any one of a hydraulic helm pump for steering the outboard engine by hydraulic pressure and a mechanical helm mechanism for mechanically steering the outboard engine.

4. The steering device of claim 1, wherein the electric assist mechanism is controlled on the basis of the detected steering torque and a number of rotations of an engine for driving a propulsion propeller of the outboard engine.

5. The steering device of claim 1, wherein the power transmission section comprises a belt that connects the steering output shaft to the helm mechanism drive shaft.

6. The steering device of claim 1, wherein the power transmission section comprises a chain that connects the steering output shaft to the helm mechanism drive shaft.

7. The steering device of claim 1, wherein the electric assist mechanism is disposed on one lateral side of said output shaft while said helm mechanism drive shaft is disposed on an opposite lateral side of said output shaft.

* * * * *